US008911866B2

(12) United States Patent
Okamoto et al.

(10) Patent No.: US 8,911,866 B2
(45) Date of Patent: Dec. 16, 2014

(54) POWDER FOR POWDER MAGNETIC CORE, POWDER MAGNETIC CORE, AND METHODS FOR PRODUCING THOSE PRODUCTS

(75) Inventors: Daisuke Okamoto, Toyota (JP); Daisuke Ichigozaki, Nagoya (JP); Shin Tajima, Nagoya (JP); Masaaki Tani, Nagoya (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 403 days.

(21) Appl. No.: 13/061,195

(22) PCT Filed: Sep. 2, 2009

(86) PCT No.: PCT/JP2009/065326

§ 371 (c)(1),
(2), (4) Date: Feb. 28, 2011

(87) PCT Pub. No.: WO2010/026984

PCT Pub. Date: Mar. 11, 2010

(65) Prior Publication Data

US 2011/0156850 A1 Jun. 30, 2011

(30) Foreign Application Priority Data

Sep. 2, 2008 (JP) ..... 2008-225153

(51) Int. Cl.

| | |
|---|---|
| ***H01F 3/08*** | (2006.01) |
| ***B05D 5/00*** | (2006.01) |
| ***B22F 3/12*** | (2006.01) |
| ***H01F 1/26*** | (2006.01) |
| ***B22F 1/00*** | (2006.01) |
| ***H01F 41/02*** | (2006.01) |
| ***B22F 1/02*** | (2006.01) |
| ***H01F 1/33*** | (2006.01) |
| *B22F 3/14* | (2006.01) |
| *B22F 3/24* | (2006.01) |
| *B22F 3/02* | (2006.01) |

(52) U.S. Cl.

CPC ..... *H01F 1/26* (2013.01); *B22F 1/0062* (2013.01); *H01F 41/0246* (2013.01); *B22F 2998/10* (2013.01); *B22F 1/02* (2013.01); *B22F 2003/145* (2013.01); *B22F 2003/248* (2013.01); *H01F 3/08* (2013.01); *H01F 1/33* (2013.01); *B22F 2003/026* (2013.01)

USPC ..... 428/407; 428/403; 335/297

(58) Field of Classification Search

None

See application file for complete search history.

(56) References Cited

U.S. PATENT DOCUMENTS 4,731,191 A 3/1988 Swihart
4,735,702 A * 4/1988 Reinhoudt et al. ..... 438/49

(Continued)

FOREIGN PATENT DOCUMENTS

DE 102 45 088 1/2004
EP 1 928 002 6/2008

(Continued)

OTHER PUBLICATIONS

International Search Report in International Application No. PCT/JP2009/065326; Mailing Date: Nov. 24, 2009.

(Continued)

*Primary Examiner* — Mark Ruthkowsky
*Assistant Examiner* — Alexandre Ferre
(74) *Attorney, Agent, or Firm* — Finnegan, Henderson, Farabow, Garrett & Dunner, LLP

(57) ABSTRACT

A powder for a powder magnetic core, a powder magnetic core, and methods of producing those products are provided, so that mechanical strength of a powder magnetic core can be enhanced by hydrosilylation reaction between vinylsilane and hydrosilane without degrading magnetic properties. The powder for a powder magnetic core is composed of magnetic particles 2 having a surface 21 coated with an insulating layer 3, wherein the insulating layer 3 includes a polymer resin insulating layer 33 comprising vinylsilane 4 and hydrosilane.

8 Claims, 12 Drawing Sheets

(56) References Cited

U.S. PATENT DOCUMENTS

| | | | | |
|---|---|---|---|---|
| 5,651,841 | A * | 7/1997 | Moro et al. | 148/309 |
| 5,800,636 | A * | 9/1998 | Tsukada et al. | 148/306 |
| 2005/0214547 | A1* | 9/2005 | Pasquier et al. | 428/447 |
| 2007/0235109 | A1* | 10/2007 | Maeda et al. | 148/307 |
| 2008/0152897 | A1* | 6/2008 | Maeda et al. | 428/323 |
| 2009/0267484 | A1 | 10/2009 | Kasakura et al. | |

FOREIGN PATENT DOCUMENTS

| | | |
|---|---|---|
| JP | 2006-233295 | 9/2006 |
| JP | 2007-88156 | 4/2007 |
| JP | 2007-194273 | 8/2007 |
| JP | 2008-88505 | 4/2008 |
| WO | WO 2006/006545 A1 | 1/2006 |
| WO | WO 2008/001799 A1 | 1/2008 |

OTHER PUBLICATIONS

K. Tauchi et al., "Synthesis of a Super-Heat-Resistant Material Having a Silsesquioxane (SQ) Skeleton," Toagosei Research Annual, Trend, vol. 7, pp. 22-28 (2004).

A. Kitamura et al., "VH-SQ: Super-Heat-Resistant Silsesquioxane Derivative," Toagosei Research Annual, Trend, vol. 11, pp. 40-45 (2008).

* cited by examiner

| | Heat treatment temperature/°C | Magnetic flux density | Eddy loss | Strength |
|---|---|---|---|---|
| Example 1 | 0 | | | 0.79 |
| | 300 | 1.40 | 0.80 | 3.03 |
| | 400 | 1.43 | 0.77 | 3.16 |
| | 500 | 1.46 | 0.78 | 2.89 |
| | 600 | 1.49 | 2.60 | 2.84 |
| | 800 | 1.50 | 14.46 | 2.65 |
| | 1000 | 1.50 | 15.80 | 1.41 |
| Comparative example 1 | 0 | | | 0.70 |
| | 300 | 0.97 | 0.84 | 1.18 |
| | 400 | 0.94 | 0.90 | 0.65 |
| | 500 | 0.96 | 0.95 | 0.71 |
| | 600 | 1.00 | 1.00 | 1.00 |
| | 800 | 1.01 | 8.60 | 0.92 |
| | 1000 | 1.01 | 13.71 | 0.86 |

FIG. 8

| | KR ratio mass % | XA ratio mass % | Heat treatment temperature/°C | Magnetic flux density | Eddy loss | Strength |
|---|---|---|---|---|---|---|
| Example 2 | 80 | 20 | 0 | | | 1.50 |
| | 80 | 20 | 300 | 1.61 | 0.70 | 2.43 |
| | 80 | 20 | 400 | 1.61 | 0.75 | 1.96 |
| | 80 | 20 | 500 | 1.62 | 0.81 | 3.21 |
| | 80 | 20 | 550 | 1.63 | 0.87 | 3.61 |
| | 80 | 20 | 600 | 1.63 | 0.94 | 3.84 |
| | 80 | 20 | 750 | 1.66 | 2.89 | 4.65 |
| | 60 | 40 | 0 | | | 1.73 |
| | 60 | 40 | 300 | 1.60 | 0.77 | 4.10 |
| | 60 | 40 | 400 | 1.60 | 0.84 | 2.83 |
| | 60 | 40 | 500 | 1.61 | 0.86 | 4.02 |
| | 60 | 40 | 550 | 1.61 | 0.90 | 5.40 |
| | 60 | 40 | 600 | 1.61 | 1.11 | 5.59 |
| | 60 | 40 | 750 | 1.65 | 1.30 | 6.43 |
| | 40 | 60 | 0 | | | 0.68 |
| | 40 | 60 | 300 | 1.60 | 0.81 | 4.77 |
| | 40 | 60 | 400 | 1.60 | 0.82 | 3.77 |
| | 40 | 60 | 500 | 1.62 | 0.84 | 4.43 |
| | 40 | 60 | 550 | 1.63 | 0.88 | 6.56 |
| | 40 | 60 | 600 | 1.62 | 0.93 | 7.06 |
| | 40 | 60 | 750 | 1.67 | 0.71 | 5.69 |
| | 20 | 80 | 0 | | | 0.50 |
| | 20 | 80 | 300 | 1.65 | 0.77 | 4.85 |
| | 20 | 80 | 400 | 1.65 | 0.79 | 3.73 |
| | 20 | 80 | 500 | 1.66 | 0.81 | 4.77 |
| | 20 | 80 | 550 | 1.66 | 0.86 | 6.13 |
| | 20 | 80 | 600 | 1.66 | 0.94 | 6.33 |
| | 20 | 80 | 750 | 1.70 | 3.09 | 5.51 |
| Comparative example 2 | 100 | 0 | 600 | 0.94 | 0.46 | 0.94 |
| Example 3 | 40 | 60 | 600 | 1.41 | 0.59 | 7.52 |

POWDER FOR POWDER MAGNETIC CORE, POWDER MAGNETIC CORE, AND METHODS FOR PRODUCING THOSE PRODUCTS

CROSS-REFERENCE TO RELATED APPLICATIONS

This application is a national phase application of International Application No. PCT/JP2009/065326, filed Sep. 2, 2009, and claims the priority of Japanese Application No. 2008-225153, filed Sep. 2, 2008, the contents of both of which are incorporated herein by reference.

TECHNICAL FIELD

The present invention relates to a powder for a powder magnetic core wherein a surface of each of the magnetic particle is coated with at least an insulating layer, a method for producing the same, a powder magnetic core made from the powder for a powder magnetic core, and a method for producing the same.

BACKGROUND ART

Magnetic cores used for a motor or the like are conventionally made by compacting powder for a powder magnetic core. The powder for making a powder magnetic core is composed of magnetic particles. Each of the magnetic particles has a surface coated with an insulating layer for securing electric insulation between the compacted magnetic particles.

Examples of the powder for a powder magnetic core include a powder for a powder magnetic core comprising magnetic particles and having a surface coated with a high insulating polymer resin such as a silicone resin that forms an insulating resin layer as the insulating layer, and a powder for a powder magnetic core comprising magnet particles and having a surface deposited with an oxide such as silica ($SiO_2$) by chemical vapor deposition (CVD) that forms an oxide insulating layer as the insulating layer. Furthermore, a powder for a powder magnetic core comprising magnetic particles and having an insulating layer formed of an oxide insulating layer and a silicone resin insulating layer (i.e. polymer resin insulating layer) in series from the magnetic particle surface in a thickness direction has been proposed. (For example, refer to Patent Documents 1 and 2.)

Patent Document 1: JP Patent Publication (Kokai) No. 2006-233295A

Patent Document 2: JP Patent Publication (Kokai) No. 2008-88505A

DISCLOSURE OF THE INVENTION

Problems to be Solved by the Invention

When a powder magnetic core is produced from a powder for a powder magnetic core comprising the powder for a powder magnetic core described above, an oxide insulating layer 93A enhances affinity between iron magnetic grains 92A and an insulating silicone resin layer 93B as shown in FIG. 18. Consequently, high resistivity of a powder magnetic core can be preserved after annealing. Up to the present date, however, high strength of a powder magnetic core has not been yet achieved due to the weakest part composed of the interface (i.e. grain boundary) between mutually joining silicone resin insulating layers 93B and 93B.

Specifically, the silicone resin insulating layer 93B of the powder for the powder magnetic core is formed by consecutive steps of coating the surface of the particle with a silicone resin comprising organic solvent, volatilizing the organic solvent at a temperature of 100° C. to 200° C., and drying the powder particles. As a result, when a powder magnetic core is formed from such powder for a powder magnetic core, few Si—O—Si bonds are, in particular, present at the interface between the silicone resin insulating layers 93B and 93B, resulting in the weak interlayer connection and insufficient strength of a powder magnetic core.

In order to solve the problem, an unreacted portion (i.e. portion unresponsive to polymerization reaction) may be left in the silicone resin coating, so that the bonds increase during annealing. However, such a method results in a large amount of volume reduction during annealing. The volume reduction is, in turn, a factor causing a decrease of resistivity of the powder magnetic core.

In view of the circumstances, the present invention has been made. An object of the present invention is to provide a powder for a powder magnetic core having an enhanced mechanical strength without degradation of magnetic properties of a powder magnetic core, a method for producing the powder, a powder magnetic core, and a method for producing the core.

Means for Solving the Problems

In order to solve the problems, a powder for a powder magnetic core of the present invention is the powder for a powder magnetic core wherein a surface of each of the magnetic particles is coated with an insulating layer, wherein the insulating layer comprises, as a surface layer, a polymer resin insulating layer comprising vinylsilane and hydrosilane.

According to the present invention, since the insulating polymer resin of the present invention includes vinylsilane Si—CH═$CH_2$ and hydrosilane Si—H, hydrosilylation reaction (addition reaction) between vinylsilane and hydrosilane at the interface between the polymer resin insulating layers (between surface layers of the insulating layers) can be induced in a step of producing a powder magnetic core.

As a result, Si—C—C—Si bonds are produced at the grain boundary between adjoining powder for a powder magnetic core (between polymer resin insulating layers). Due to the interlayer chemical bonds, mechanical strength of a powder magnetic core can be enhanced without degradation of magnetic properties of the powder magnetic core. In addition, since the heating temperature region for inducing the hydrosilylation reaction overlaps the heating temperature region during annealing of a formed powder magnetic core, the reaction can be induced concurrently with the annealing.

The composition of the polymer resin insulating layer of the powder for a powder magnetic core of the present invention is not specifically limited provided that the insulating polymer resin comprises vinylsilane and hydrosilane. Examples of the polymer resin include a polyimide resin, a polyamide resin, an aramid resin and a silicone resin. The more preferred polymer resin insulating layer is composed of a silicone resin such as a so-called addition-curable silicone resin.

The term "powder for a powder magnetic core" in this invention refers to an aggregate of magnetic particles having a surface coated with an insulating layer. The term "insulating layer" in this invention refers to a layer for securing electric insulation between compacted magnetic powder (particles).

And the term "surface layer" in this invention refers to the external layer of insulating layers coating the powder for a powder magnetic core.

Preferably the powder for a powder magnetic core of the present invention further includes an oxide insulating layer as the insulating layer between the magnetic particle and the polymer resin insulating layer. The oxide insulating layer of the present invention can further enhance affinity (adhesion) between the magnetic particle and the polymer resin insulating layer.

The oxide insulating layer of each of the particles the powder for a powder magnetic core of the present invention is not specifically limited provided that the layer enhances the affinity between the magnetic particle and the polymer resin insulating layer. Examples of the layer include an insulating layer comprising an oxide of ceramic material such as silica, alumina or zirconia, and an insulating layer comprising an oxide derived from oxidizing the surface of the magnetic powder and an inorganic salt such as phosphate. The oxide insulating layer having heat-resistant is preferable.

However, a more preferable oxide insulating layer is an insulating layer comprising a phosphate salt or an Al—Si-based oxide. Such an oxide insulating layer can further enhances the affinity between the magnetic particle and the polymer resin insulating layer and preserve magnetic properties of the powder magnetic core after annealing.

In an alternative aspect, preferably the oxide insulating layer of the powder for a powder magnetic core of the present invention includes two-layer structure composed of an insulating layer comprising a phosphate salt and an insulating layer comprising an Al—Si-based oxide arranged in series from the magnetic particle surface toward the polymer resin insulating layer. In the present invention, the formation of the insulating layer comprising a phosphate salt on the magnetic particle surface enhances adhesion between the insulating layer comprising the phosphate salt and the magnetic particle, and the lamination of the insulating layer comprising an Al—Si-based oxide and the polymer resin insulating layer in series can enhance adhesion between these layers. Accordingly, affinity of the polymer resin insulating layer to the magnetic particle is further enhanced.

In addition, preferably the oxide insulating layer of the powder for a powder magnetic core of the present invention comprises vinylsilane. In the present invention, the inclusion of the vinylsilane in the oxide insulating layer further induces hydrosilylation reaction between vinylsilane and hydrosilane at the interface between the oxide insulating layer and the polymer resin insulating layer in a step of producing a powder magnetic core. As a result, Si—C—C—Si bonds are produced not only between polymer resin insulating layers of adjoining grains for a powder magnetic core but also between the oxide insulating layer and the polymer resin insulating layer. This interlayer chemical bond can further stabilize mechanical strength of a powder magnetic core.

In the meantime, since the polymer resin insulating layer comprising vinylsilane and hydrosilane described above can produce hydrosilylation reaction in a compacted powder magnetic core during annealing, strength and magnetic properties of the powder magnetic core are more enhanced compared to those of a powder magnetic core produced by a conventional method. Accordingly, the layer is suitable for use in a powder magnetic core. In certain instances, however, magnetic properties of the powder magnetic core degrade inversely with the more enhanced strength.

The present inventors have found the following through keen examinations for further enhancing magnetic properties. In particular, hydrosilylation reaction during annealing causes organic substance of the polymer resin insulating layer to carbonize or volatilize, resulting in volume reduction of the polymer resin insulating layer due to shrinkage. Accordingly, insulation between magnetic particles degrades in certain instances. Specifically, since iron-based magnetic powder has an annealing temperature of not lower than 600° C., heating in such a temperature region significantly causes the volume reduction as described above. Consequently, eddy-current losses increase in a compacted powder magnetic core composed of the iron-based magnetic powder. The new finding is that magnetic properties of such a powder magnetic core thus degrade in certain instances.

The invention of a powder for a powder magnetic core described below is based on this new finding. The powder for a powder magnetic core of the present invention is premised on the powder for a powder magnetic core described above and more preferably includes the polymer resin insulating layer further comprising a silicon oxide precursor that produces silicon oxide by heating.

In the present invention, due to the inclusion of the silicon oxide precursor, homogeneously dispersed silicon oxide phases are produced in the polymer resin insulating layer of a powder magnetic core during annealing so as to inhibit volume reduction of the polymer resin insulating layer. Accordingly, insulation between the magnetic particles of a powder magnetic core is preserved. Consequently, the eddy-current losses are inhibited to preserve more enhanced magnetic properties.

The silicon oxide precursor is not specifically limited, provided that the precursor produces silicon oxide phases in the polymer resin insulating layer at least under a temperature condition for inducing hydrosilylation reaction. The phase may be either one of a crystallized phase, an amorphous phase, and a combined phase of these. In other words, the kind of silicon oxide precursor is not specifically limited, provided that the precursor produces siloxane structure represented by a formula such as —(Si—O)n- (where n is not less than 2) during heating. Examples of such a silicon oxide precursor include methyl-based straight silicone resins. The silicone resins or silicone oil having a siloxane skeleton may have a functional group in side chains that is not specifically limited. The silicone resin is not specifically limited, provided that the contents of Si and O are sufficient. Preferably the side chains of the silicone resin further comprise a methyl group or an ethyl group.

Alternatively, the silicon oxide precursor may be polymethylsiloxane, polyethyl silicate, octamethylcyclotetrasiloxane, hexamethyldisiloxane, octamethyltrisiloxane, hexamethylcyclotrisiloxane, decamethylcyclopentasiloxane, tetraethyl orthosilicate, or a combination of these.

Hydrosilylation reaction between vinylsilane and hydrosilane is induced in a compacted powder magnetic core in a heating region during annealing as described above. Concurrently, the silicon oxide precursor can further produce silicon oxide (as a phase) in the polymer resin insulating layer.

More preferably, a rate of the polymer resin of the powder for a powder magnetic core (ratio of the polymer resin insulating layer to one particle) is not higher than 0.6% by mass. The polymer resin insulating layer is formed so as to have the ratio, with which the strength (ring compression strength) of a powder magnetic core can be enhanced. The term "a ratio of the polymer resin insulating layer" used in the present invention refers to a ratio of the polymer resin comprised in the powder for a powder magnetic core to the entire powder. Accordingly, "a ratio of not higher than 0.6% by mass" means that each particle of powder is coated with not higher than 0.6% by mass of polymer resin as an insulating layer on average.

In the present invention of the powder for a powder magnetic core, more preferably, the silicone resin that constitutes the insulating silicone resin layer has side chains comprising a methyl group and a vinyl group for inducing hydrosilylation reaction with the hydrosilane, wherein the silicone resin comprises the vinyl group at 2% to 10% in all the side chains and the methyl group at 38% to 77% in all the side chains.

In the present invention, the silicone resin comprises a vinyl group in side chains, or a vinyl group of vinylsilane inducing hydrosilylation reaction with hydrosilane (Si—H) at 2% to 10% in all the side chains. As a result, the silicone resin comprises hydrosilane (Si—H) at a content ratio equal to or higher than that of vinyl group. Accordingly, strength of the powder magnetic core can be positively enhanced after annealing. Sufficient strength cannot be produced with less than 2% of the vinyl group. In contrast, the methyl group described below cannot be comprised together with more than 10% of the vinyl group. In addition, when the silicone resin has methyl group in side chains with an amount of 38% to 77% of the methyl groups in all the side chains, eddy losses can be reduced.

The term "magnetic particles" used in the present invention refers to an aggregate of magnetic particles (powder) having magnetic permeability. Preferably soft magnetic metal particles (powder) are used. Examples of the material include iron, cobalt, and nickel. More preferable examples include iron-based material such as iron (pure iron), iron-silicon alloy, iron-nitrogen alloy, iron-nickel alloy, iron-carbon alloy, iron-boron alloy, iron-cobalt alloy, iron-phosphorus alloy, iron-nickel-cobalt alloy, and iron-aluminum-silicon alloy. Examples of the magnetic powder include water-atomized powder, gas-atomized powder, or pulverized powder. In order to inhibit destruction of an insulating layer during compacting, preferably powder having fewer surface asperities is selected.

A preferred method for producing the powder for a powder magnetic core of the present invention is disclosed below. The method for producing the powder for a powder magnetic core of the present invention is a method for producing the powder for a powder magnetic core comprising magnetic particles wherein a surface of each of the magnetic particles is coated with an insulating layer, wherein the insulating layer has a surface layer obtained by coating a polymer resin insulating layer comprising vinylsilane and hydrosilane. More preferably, the polymer resin insulating layer further comprises a silicon oxide precursor that produces silicon oxide by heating. Further preferably, the polymer resin is added to the magnetic particles so that the polymer resin accounts for not higher than 0.6% by mass to the powder for a powder magnetic core to perform the coating of a polymer resin insulating coating layer.

More preferably, the polymer resin is a silicone resin that has side chains comprising a methyl group and a vinyl group for inducing hydrosilylation reaction with the hydrosilane, wherein the silicone resin comprises the vinyl group at 2% to 10% in all the side chains and the methyl groups at 38% to 77% in all the side chains.

In addition, more preferably the insulating polymer resin coating layer is heat-treated in a heating temperature region of 100° C. to 160° C. during a heating period of 10 min to 45 min. When the heating temperature is lower than 100° C., or when the heating period is less than 10 min, powder flowability is impaired supposedly due to unreacted functional groups. Specifically, when metal powder flowability is measured with a specified funnel in JIS2502-2000, the powder does not flow from the funnel due to the impaired flowability. The impaired flowability causes serious problems in mass production of a powder magnetic core. When the heating temperature is higher than 160° C., or when the heating period is more than 45 min, silicon oxide is substantially produced before forming of the compacted powder magnetic core. Accordingly, silicon oxide is barely produced between particles during annealing of the powder magnetic core. Sufficient effect of enhancing strength of the powder magnetic core is thus not produced.

In the method for producing a powder for a powder magnetic core of the present invention, the insulating layer may include an oxide insulating layer between the magnetic particle and the polymer resin insulating layer for coating the surface of particle with the oxide layer. Preferably the oxide insulating layer in this case is an insulating layer comprising a phosphate salt or an Al—Si-based oxide. In an alternative aspect, preferably the oxide insulating layer includes a two-layer structure composed of an insulating layer comprising a phosphate salt and an insulating layer comprising an Al—Si-based oxide arranged in series from the magnetic particle surface toward the polymer resin insulating layer. The oxide insulating layer may further comprise vinylsilane.

A preferred method for producing a powder magnetic core of the present invention using the powder for a powder magnetic core or the powder produced by the production method is also disclosed below. The method for producing a powder magnetic core of the present invention includes at least steps of compacting the powder for a powder magnetic core into a powder magnetic core and heating the powder magnetic core for inducing hydrosilylation reaction between the vinylsilane and the hydrosilane.

In the present invention, hydrosilylation reaction between insulating layers induced by heating the compacted powder magnetic core produces Si—C—C—Si bonds as described above. Consequently, mechanical strength of the powder magnetic core can be enhanced. In other words, the chemical bonds can be produced between the adjoining polymer resin insulating layers. Furthermore, when the oxide insulating layer comprises vinylsilane or hydrosilane, the chemical bonds can be produced also between the oxide insulating layer and the polymer resin insulating layer.

In addition, when the polymer resin insulating layer comprises a silicon oxide precursor, homogeneously dispersed silicon oxide phases are produced in the polymer resin insulating layer during annealing so as to inhibit volume reduction of the polymer resin insulating layer caused by shrinkage.

The hydrosilylation reaction can be induced by using a catalyst, heating, or a combination of both. More preferably the heating of the powder magnetic core in the production method is performed under a temperature condition of 300° C. to 1000° C.

In the present invention, the hydrosilylation reaction between vinylsilane and hydrosilane is conveniently induced by heating in the temperature region without using a catalyst. In addition, since the powder magnetic core is annealed in the temperature range, strains introduced to the powder magnetic core can be removed concurrently with the reaction.

When the polymer resin insulating layer further comprises a silicon oxide precursor, silicon oxide is produced on the polymer resin insulating layer in the powder magnetic core to be able to inhibit volume reduction of the polymer resin insulating layer. Consequently, iron loss of the produced powder magnetic core is inhibited.

Specifically, when the heating temperature is lower than 300° C., it is difficult to induce the hydrosilylation reaction without using a catalyst. In addition, when a silicon oxide precursor is included, it is difficult to produce silicon oxide from the precursor in the temperature range. In contrast, when the heating temperature is higher than 1000° C., Si—C—C—Si bonds produced by hydrosilylation reaction are destroyed. Consequently, mechanical strength of the powder magnetic core is degraded and insulation of the powder magnetic core is not secured.

In the method for producing a powder magnetic core of the present invention, more preferably the heating for inducing hydrosilylation reaction and annealing the powder magnetic core is performed in an oxygen-free atmosphere. In the present invention, oxidation of the powder magnetic core is inhibited by annealing in an oxygen-free atmosphere. Examples of the oxygen-free atmosphere include an inert gas atmosphere such as nitrogen gas, argon gas, or helium gas, or vacuum. The atmosphere is not specifically limited, provided that oxidation of the powder magnetic core by oxygen gas can be inhibited.

A powder magnetic core conveniently made from the powder for a powder magnetic core of the present invention is also disclosed below. The powder magnetic core of the present invention is a powder magnetic core comprising magnetic grains coated with an insulating layer, wherein the insulating layer of the powder magnetic core includes a polymer resin insulating layer that forms grain boundaries of the grains coated with the insulating layer, and there are Si—C—C—Si bonds between the polymer resin insulating layers of the adjoining magnetic grains.

In the present invention, due to the presence of Si—C—C—Si bonds between the polymer resin insulating layers of adjoining magnetic grains coated with the insulating layer, the powder magnetic core can have sufficient strength preserving magnetic properties that are equal to or superior to conventional ones.

The magnetic grains constituting the powder magnetic core of the present invention correspond in form to the compacted magnetic particles composing the powder for a powder magnetic core with the same composition as of the magnetic particles described above. The magnetic grains coated with an insulating layer composing the powder magnetic core correspond in form to the compacted particle composing the powder for a powder magnetic core (magnetic particles having a surface coated with an insulating layer).

More preferably, an oxide insulating layer is further formed between the magnetic grain and the polymer resin insulating layer. Furthermore, more preferably the oxide insulating layer is an insulating layer comprising a phosphate salt or an Al—Si-based oxide. In an alternative aspect, the oxide insulating layer includes a two-layer structure composed of an insulating layer comprising a phosphate salt and an insulating layer comprising an Al—Si-based oxide arranged in series from the magnetic grain surface toward the polymer resin insulating layer. These oxide insulating layers can enhance affinity between the magnetic grain and the insulating layer as described for the powder for a powder magnetic core.

More preferably, the powder magnetic core of the present invention has Si—C—C—Si bonds between the oxide insulating layer and the polymer resin insulating layer. In the present invention, the interlayer chemical bonds can further stabilize mechanical strength of the powder magnetic core.

More preferably, the powder magnetic core of the present invention has the polymer resin insulating layer further comprising silicon oxide. More preferably the silicon oxide is comprised as a phase having siloxane structure represented by formulae such as —(Si—O)n- (where n is not less than 2). In the present invention, the inclusion of silicon oxide in the polymer resin insulating layer can reduce iron losses to enhance magnetic properties of the powder magnetic core.

Such a powder magnetic core having secured mechanical strength and superior insulation and magnetic properties is suitable for use in a stator or a rotor composing a motor for driving a hybrid electric vehicle or an electric vehicle and a core for a reactor composing a power converter (reactor core).

Advantages of the Invention

In the present invention, mechanical strength of a powder magnetic core can be enhanced by hydrosilylation reaction between vinylsilane and hydrosilane without degrading magnetic properties.

BRIEF DESCRIPTION OF THE DRAWINGS

FIG. 8 is a table showing experimental conditions and results of ring compression strength, eddy current loss, and magnetic flux density in Examples 2 and 3 and Comparative Example 2.

DESCRIPTION OF SYMBOLS

2: magnetic particle, 2A: magnetic grain, 3, 3A: insulating layer, 4: vinylsilane, 10: particle coated with insulating layer, 10A: grain coated with insulating layer, 31, 31A: insulating layer comprising a phosphate salt (oxide insulating layer), 32, 32A: insulating layer comprising an Al—Si-based oxide (oxide insulating layer), 33, 33', 33A, 33B: polymer resin insulating layer, 100: powder magnetic core

BEST MODE FOR CARRYING OUT THE INVENTION

With reference to the attached drawings, a powder for a powder magnetic core of the present invention is described based on an embodiment.

Figure 1:
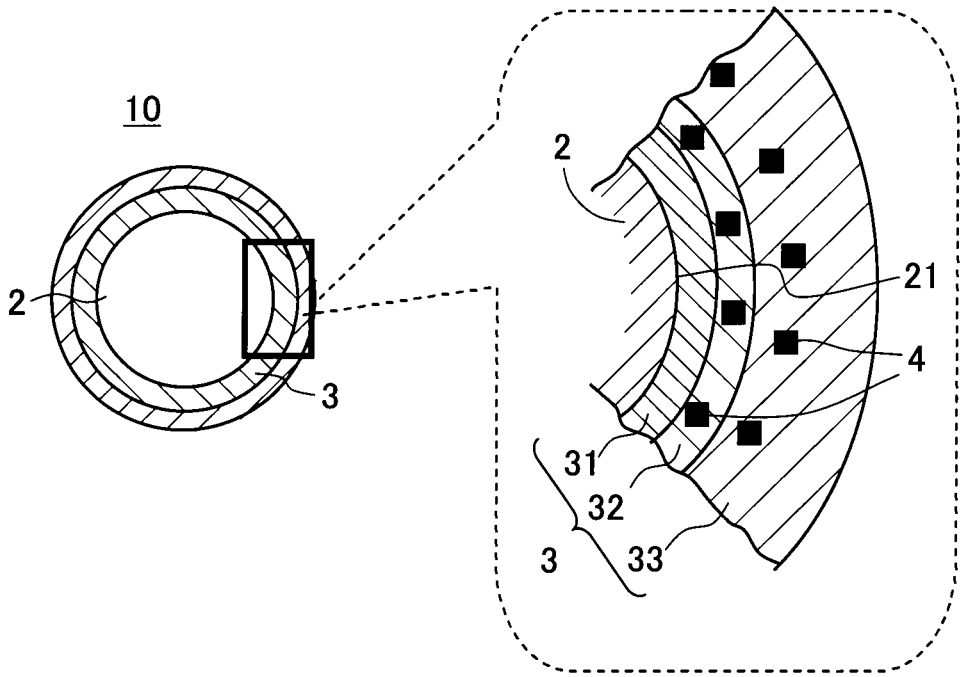
FIG. 1 is a schematic view of a powder for a powder magnetic core in accordance with an embodiment of the present invention.

FIG. 1 is a schematic view of a powder for a powder magnetic core in accordance with an embodiment of the present invention. As shown in FIG. 1, the powder for a powder magnetic core of the embodiment is an aggregate of particles 10 coated with an insulating layer 3. The surface 21 of an iron magnetic particle 2 is coated with the insulating layer 3. The insulating layer 3 includes an after-mentioned polymer resin insulating layer 33 as a surface layer (outer layer) of the particle of the powder for a powder magnetic core 10.

The magnetic particle 2 is a soft magnetic particle composed of pure iron produced by gas-atomizing (particle composed of gas-atomized powder) having a mean diameter of not larger than 450 μm. The insulating layer 3 is a layer having multi-layer structure including oxide insulating layers 31 and 32 and polymer resin insulating layer 33.

The oxide insulating layers 31 and 32 are layers formed between the magnetic particle 2 and the polymer resin insulating layer 33 and have two-layer structure including the insulating layer 31 comprising a phosphate salt and the insulating layer 32 comprising an Al—Si-based oxide comprising vinylsilane 4. The insulating layer 31 comprising a phosphate salt coats the surface 21 of the magnetic particle 2, and the insulating layer 32 comprising an Al—Si-based oxide further coats the insulating layer 31 comprising a phosphate salt. Accordingly, the oxide insulating layers form the insulating layer 31 comprising a phosphate salt and the insulating layer 32 comprising an Al—Si-based oxide arranged in series from the surface of the magnetic particle 2 toward the polymer resin insulating layer 33.

The insulating layer 31 comprising a phosphate salt and the insulating layer 32 comprising an Al—Si-based oxide function as underlayers. The insulating layer 31 comprises phosphate such as PO, SrPO, or SrBPO. More preferably it is desirable that the layer comprises SrBPO. It is desirable that the insulating layer 32 is made from Al—Si-based alkoxide. The polymer resin insulating layer 33 is an insulating layer of silicone resin comprising vinylsilane 4 and hydrosilane and coats the surface of the insulating layer 32 comprising an Al—Si-based oxide.

The powder for a powder magnetic core described above is produced as described below. First, the magnetic powder composed of pure iron produced by gas-atomizing is prepared. The magnetic powder composed of the magnetic particles 2 is phosphate-treated. The phosphate treatment is a commonly known treatment. For example, phosphoric acid as a base component, strontium carbonate, and boric acid are dissolved in ion-exchanged water to make a treatment liquid. The magnetic powder is immersed in the treatment liquid. The treatment liquid is stirred and subsequently dried in a nitrogen atmosphere. Consequently, the insulating layer 31 comprising oxide by oxidation of the magnetic particle surface and phosphate can be produced. The insulating layer 31 described above is a coating made from a portion of the magnetic particle 2 and has sufficient affinity with the insulating layer 32 that is described below.

Subsequently, Si-alkoxide such as aminopropyltriethoxysilane (preferably Si-alkoxide further including vinyltrimethoxysilane) and Al-alkoxide (e.g. aluminum isobutoxide) are blended in a dehydrated organic solvent (e.g. tetrahydrofuran) to make a solution comprising alkoxides. The magnetic powder is immersed in the solution comprising alkoxides and dried to remove the dehydrated organic solvent. Consequently, the insulating layer 32 comprising Si—Al-based oxide is further formed on the surface of the insulating layer 31. When vinyltrimethoxysilane is further included, the insulating layer 32 comprises vinylsilane.

Subsequently, an addition-curable silicone resin comprising vinylsilane and hydrosilane is dissolved in an organic solvent such as alcohol to make a solution comprising the silicone resin. The powder composed of magnetic particles 2 having the insulating layer 32 is immersed in the solution and then dried to remove the organic solvent. Consequently, the polymer resin insulating layer 33 comprising a silicone resin is further formed on the surface of the insulating layer 32.

When the insulating layers 31, 32, and 33 are formed, the temperatures for evaporating the dehydrated organic solvent and the organic solvent are at least 100° C. to 160° C. to inhibit inducing hydrosilylation reaction between vinylsilane and hydrosilane described below. Alternatively, the silicone resin may comprise a curing catalyst. However, since the catalyst induces hydrosilylation reaction at lower temperature during drying in certain instances, the curing catalyst is not included in the embodiment.

Figure 2:
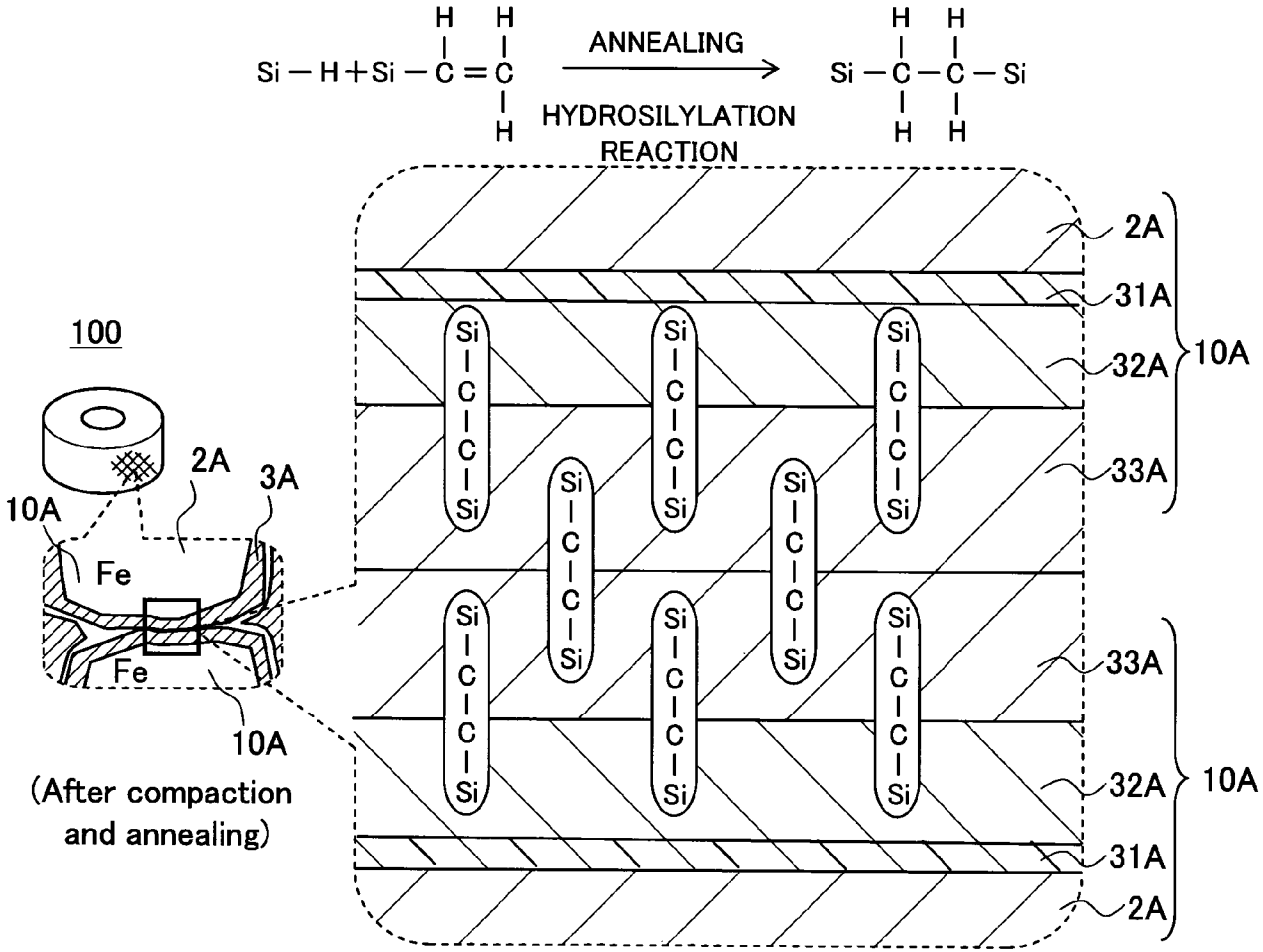
FIG. 2 illustrates a powder magnetic core in accordance with an embodiment of the present invention and a method for producing the core.

A powder magnetic core is produced from the powder for a powder magnetic core that is an aggregate of particles 10 coated with an insulating layer produced as described above. FIG. 2 illustrates a powder magnetic core in accordance with an embodiment of the present invention and a method for producing the core. Each compacted component of the particle 10 coated with insulating layers shown in FIG. 1 corresponds to the component having a symbol with suffix "A" in FIG. 2. For example, the magnetic grain 2A composing the powder magnetic core 100 in FIG. 2 corresponds to the compacted magnetic particle 2 composing the powder for a powder magnetic core, having the same composition as of the magnetic particle 2 shown in FIG. 1. The grain 10A coated with insulating layers composing the powder magnetic core 100 also corresponds to the compacted form of the particle 10 coated with insulating layers composing the powder for a powder magnetic core in FIG. 1.

First, the inner surface of a die is coated with a higher fatty acid-based lubricant. The die is filled with the powder for a powder magnetic core described above for compaction. The die may be heated for employing die-wall lubricating warm compaction. Preferably the compaction is performed under a pressure of 500 MPa to 2000 MPa. By using a lubricant, seizure between the powder magnetic core and the die is prevented. Accordingly, the compaction can be performed under higher pressure without difficulty in releasing from the die.

In this way, the powder magnetic core including the grain 10A coated with an insulating layer 3A on the surface of the magnetic grain 2A is formed as shown in FIG. 2. The insulating layer 3A forms a polymer resin insulating layer 33A as a surface layer of the grain 10A coated with the insulating layers. In other words, the insulating layer 3 of the powder magnetic core 100 has a polymer resin insulating layer 33A that composes the grain boundary between the grains 10A and 10A coated with the respective insulating layers. An insulating layer comprising a phosphate salt 31A and an insulating layer 32A comprising an Al—Si-based oxide are arranged between the magnetic grain 2A and the polymer resin insulating layer 33A in series from the magnetic grain 2A toward the polymer resin insulating layer 33A.

Subsequently, hydrosilylation reaction between vinylsilane and hydrosilane is induced as shown in FIG. 2. Specifically, the compacted powder magnetic core is heated in a temperature range of 300° C. to 1000° C., more preferably in a nitrogen atmosphere or vacuum (oxygen-free atmosphere). Consequently, hydrosilylation reaction between vinylsilane and hydrosilane is induced between the insulating layer 32A comprising an Al—Si-based oxide of the powder particles for a powder magnetic core and the polymer resin insulating layer 33A and between the adjoining polymer resin insulating layers 33A and 33A of the powder particles for a powder magnetic core, concurrently with annealing of the powder magnetic core 100. In the embodiment of the present invention, hydrosilylation reaction can be induced concurrently with annealing of the powder magnetic core to produce Si—C—C—Si bonds as described above.

Through such a heat treatment, Si—C—C—Si bonds are produced between the insulating layer 32A of the grain 10A coated with insulating layers and the polymer resin insulating layer 33A (grain boundary of grains coated with insulating layers) and between the adjoining polymer resin insulating layers 33A and 33A of the powder particles for a powder magnetic core as shown in FIG. 2, and through the concurrent annealing, strains in the magnetic grain 2A of the powder magnetic core introduced during compaction can be removed.

Since the insulating layer 31A comprising a phosphate salt is formed on the surface of the magnetic grain 2A, adhesion between the insulating layer 31A comprising a phosphate salt and the magnetic grain 2A is enhanced. Furthermore, the lamination of the insulating layer 32A comprising an Al—Si-based oxide and the polymer resin insulating layer 33A in series can enhance the interlayer adhesion. Consequently, affinity of the polymer resin insulating layer 33A to the magnetic grain 2A is further enhanced.

Figure 3:
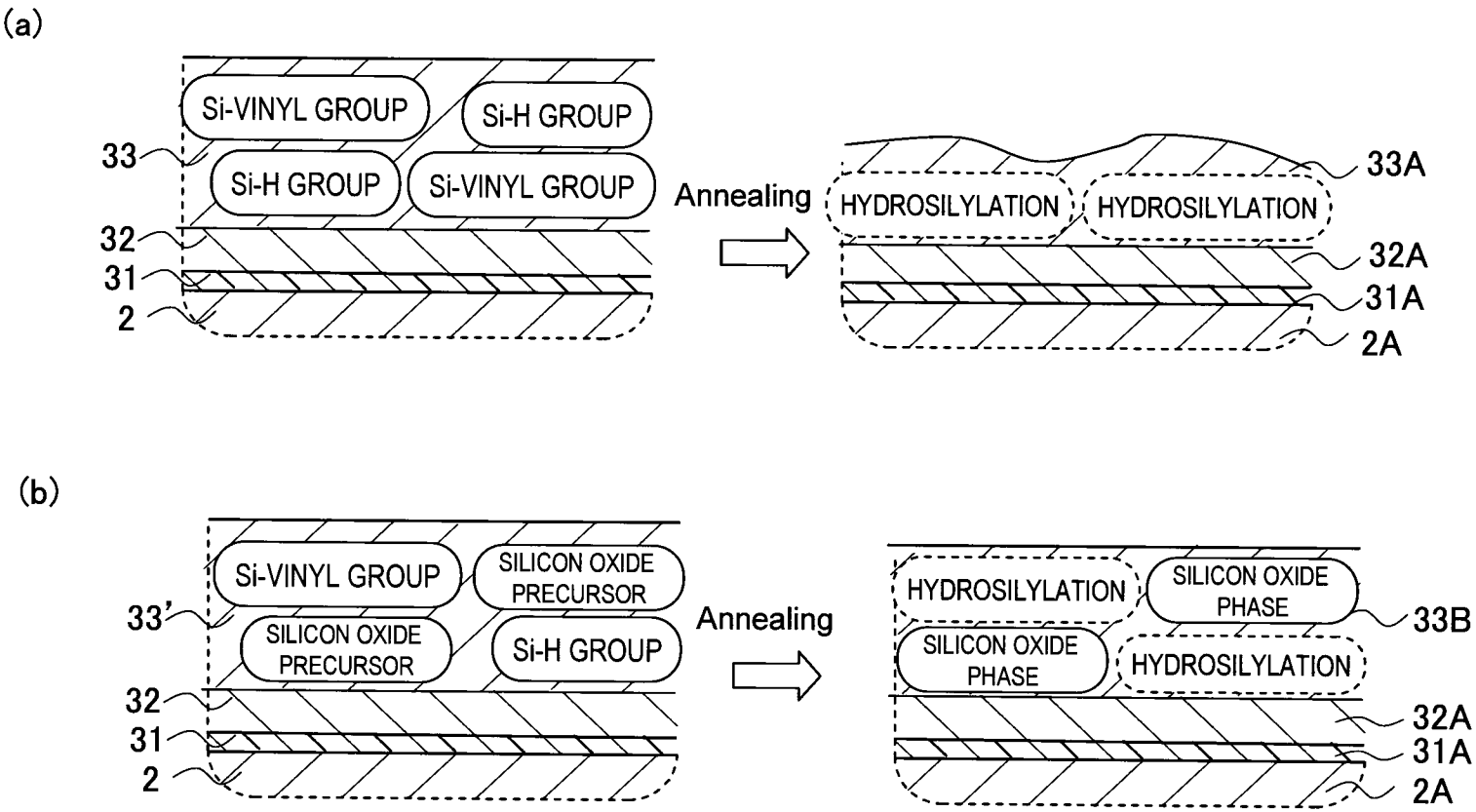
FIG. 3 illustrates states of a polymer resin of a powder magnetic core in accordance with an embodiment of the present invention before and after annealing; (a) illustrates a polymer resin comprising no silicon oxide precursor; (b) illustrates a polymer resin comprising silicon oxide precursors.

In the meantime, since the polymer resin insulating layer 33 comprising vinylsilane and hydrosilane can produce Si—C—C—Si bonds by hydrosilylation reaction during annealing after compaction of the powder magnetic core as shown in FIG. 3(*a*), the powder magnetic core has enhanced mechanical strength and magnetic properties can be enhanced compared to conventional powder magnetic cores. However, carbonization or gasification of a portion of polymer resin insulating layer during annealing causes volume reduction in the polymer resin insulating layer 33 to degrade insulation between the magnetic particles in certain instances.

In particular, when annealing is performed at a temperature of higher than 600° C. to remove strains introduced during molding in the magnetic grain 2A, this phenomenon is notable. Consequently, since the molded powder magnetic core has increased eddy current losses, magnetic properties of the powder magnetic core degrade in certain instances.

Therefore, a silicon oxide precursor (methyl-based straight silicone resin) is added to the polymer resin insulating layer 33 described above to form a polymer resin insulating layer 33' as shown in FIG. 3(*b*). This kind of silicon oxide precursor produces a phase of silicon oxide by heating at a temperature of not lower than 300° C.

A specific method of the inclusion (addition) is described below. In the step of forming the polymer resin insulating layer 32 described above, a silicon oxide precursor or a resin having increased numbers of methyl groups (methyl-based straight silicone resin) is added to an addition-curable silicone resin. These are dissolved in an organic solvent such as alcohol for immersing the magnetic powder 2 having the insulating layer 32. Through subsequent drying, the organic solvent is removed for producing the layer. Since the drying temperature is lower than 300° C. (preferably from 100° C. to 160° C.), the polymer resin insulating layer 33' comprises Si—C═C and Si—H instead of Si—C—C—Si, which is not produced yet in this stage.

Subsequently, the produced magnetic powder is compacted and annealed to produce a powder magnetic core in the same way as described above. During the annealing, the hydrosilylation reaction described above is induced to produce Si—C—C—Si bonds together with silicon oxide phases as shown in FIG. 3(*b*). The silicon oxide phase may be either one of a crystallized phase, an amorphous phase, and a combined phase of these. Such a phase having siloxane structure represented by a formula such as —(Si—O)n- (where n is not less than 2) inhibits volume reduction in the polymer resin insulating layer 33B of the produced powder magnetic core. Accordingly, with secured mechanical strength of the powder magnetic core, degradation of insulation between magnetic grains 2A and 2A is inhibited, or eddy current losses (iron losses) can be inhibited.

EXAMPLES

The present invention will be described hereunder by reference to examples.

Example 1

<Preparation of a Powder for a Powder Magnetic Core>

Gas-atomized powder (iron powder) composed of pure iron particles having a particle diameter of 150 μm to 212 μm was prepared to undergo underlying surface treatment including phosphating. Specifically, 0.57 g of strontium carbonate, 0.15 g of boric acid, and 1.1 g of phosphoric acid were dissolved in 100 ml of ion-exchanged water to prepare a coating liquid. In a 500 ml beaker, 100 g of the iron powder was placed and 20 ml of the coating liquid was added. The mixture was stirred gently. Subsequently, the specimen was dried in a nitrogen atmosphere of an inert oven at 120° C. for one hour to form an insulating layer comprising a phosphate salt.

Subsequently, 0.4 g of a silicone resin (X-40-2667A made by Shin-Etsu Chemical Co., Ltd.) comprising vinylsilane and hydrosilane was dissolved in 50 ml of isopropyl alcohol. The iron powder described above was put in this solution. The solution and the powder were stirred under heat with an external heater during a period ranging from 30 min to 120 min allowing the solvent to evaporate. Drying was performed in a temperature range from 100° C. to 200° C. In this way, the powder for a powder magnetic core of which magnetic particle has a silicone resin insulating layer comprising vinylsilane and hydrosilane on the magnetic particle surface was produced. The coating of the silicone resin insulating layer was applied by adding 0.4% by mass of silicone resin to the powder for a powder magnetic core.

<Preparation of Ring Specimen>

The powder for a powder magnetic core was put in a die to produce a ring-shaped powder magnetic core having an outer diameter of 39 mm, an inner diameter of 30 mm, and a thickness of 5 mm by die-wall lubricating warm compaction with a die temperature of 130° C. and a molding pressure of 1600 MPa. After the molding, heat treatment was performed in a nitrogen atmosphere under the conditions shown in FIG. 4 in a temperature range of 300° C. to 1000° C. for one hour.

Comparative Example 1

In the same way as for Example 1, a powder for a powder magnetic core was prepared. The difference from Example 1 was that phosphating was not applied and a silicone resin (KR242A made by Sin-Etsu Chemical Co., Ltd.) not comprising vinylsilane and hydrosilane was used to prepare the silicon resin insulating layer. In the same way as for Example 1, the powder magnetic cores were produced under the conditions shown in FIG. 4.

[Evaluation 1]

<Evaluation of the Ring Specimen>

Ring compression strength of the produced ring specimens of Example 1 and Comparative Example 1 was evaluated with an autograph. Using the ring specimen wound with a coil, the magnetic flux density was evaluated with a direct current magnetic fluxmeter and the eddy loss was evaluated with an alternate current BH analyzer. The results are shown in FIGS. 4 to 7. The magnetic flux density, the ring compression strength, and the eddy loss in Example 1 and Comparative Example 1 shown in FIGS. 4 to 7 are represented by values normalized to the magnetic flux density, the ring compression strength, and the eddy loss of the powder magnetic core in Comparative Example 1 that was heat-treated at a temperature (annealing temperature) of 600° C. as references (1.0), respectively. The hereinafter shown values in Examples and Comparative Examples are also normalized in the same way.

(Result 1 and Discussion 1)

Figures 4, 5:
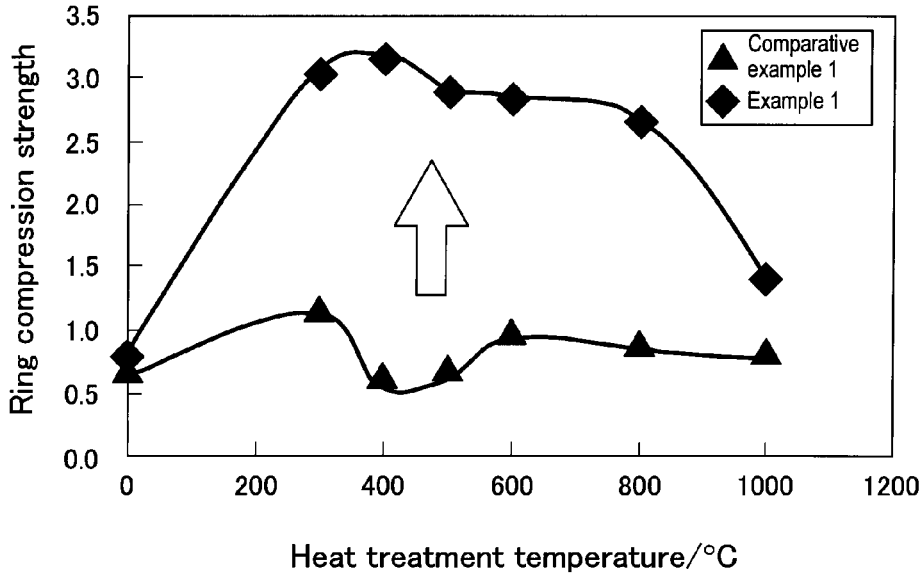
FIG. 4 is a table showing experimental conditions and results of ring compression strength, eddy loss, and magnetic flux density in Example 1 and Comparative Example 1.
FIG. 5 illustrates relations between ring compression strength versus heat treatment temperature in Example 1 and Comparative Example 1.

As shown in FIG. 5, in order to enhance the ring compression strength of the ring specimens in Example 1, it is contemplated that heat treatment at a temperature in the range of 300° C. to 1000° C. is preferable. In Example 1, the ring compression strength was notably enhanced at a heat treatment temperature (heating temperature) of 300° C. to 800° C., more preferably 300° C. to 400° C.

The temperature corresponds to the heat treatment temperature region in which hydrosilylation reaction between vinylsilane and hydrosilane is actively induced. Accordingly, it is contemplated that the enhancement of ring compression strength in Example 1 resulted from Si—C—C—Si bonds between the silicone resin insulating layers produced by hydrosilylation reaction between vinylsilane and hydrosilane. It is speculated that the ring compression strength in Example 1 degraded with a temperature higher than 1000° C., due to destruction of Si—C—C—Si bonds formed by hydrosilylation reaction.

Figure 6:
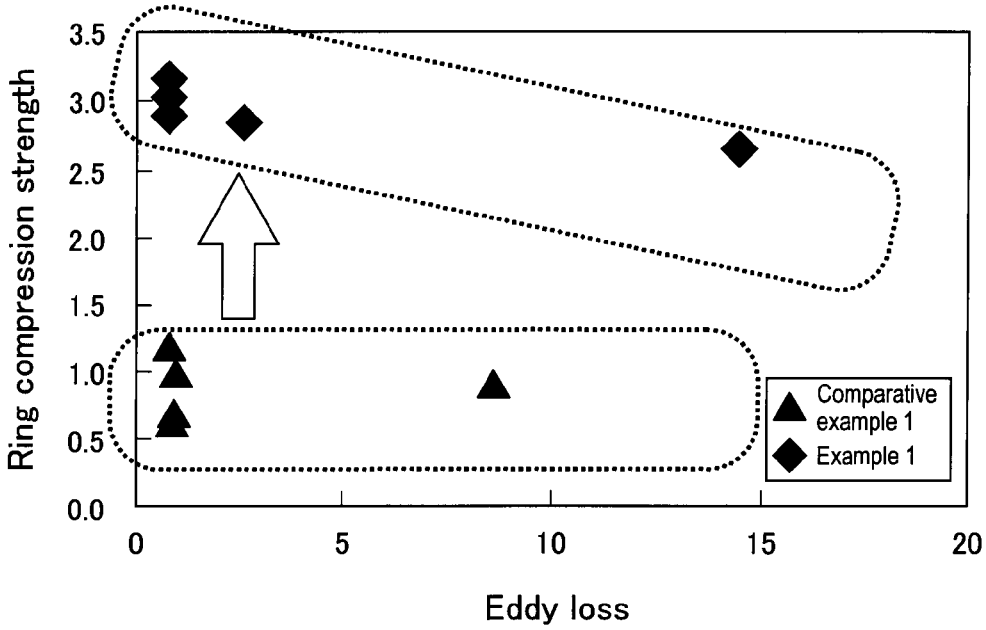
FIG. 6 illustrates ring compression strength versus eddy loss in Example 1 and Comparative Example 1.
Figure 7:
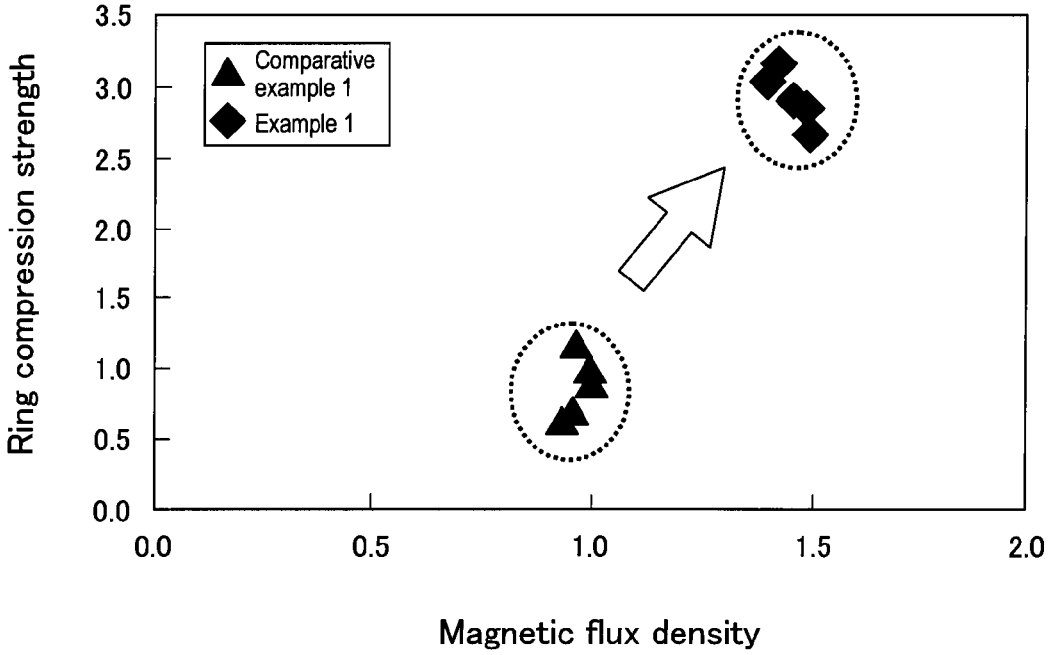
FIG. 7 illustrates ring compression strength versus magnetic flux density in Example 1 and Comparative Example 1.

As shown FIG. 6, although comparable eddy losses were exhibited in Example 1 and Comparative Example 1, enhanced ring compression strength was achieved in Example 1. As shown FIG. 7, higher magnetic flux density with higher strength was exhibited in Example 1 compared to Comparative Example 1. Accordingly, it is contemplated that higher mechanical strength with magnetic properties comparative to those in Comparative Example 1 was achieved in Example 1.

Example 2

In the same way as for Example 1, a powder for a powder magnetic core was prepared. The difference from Example 1 was the method for producing the silicone resin insulating layer comprising vinylsilane and hydrosilane. Specifically, 0.32 g (80% by mass) of a silicone resin (X-40-2667A made by Shin-Etsu Chemical Co., Ltd.: hereinafter referred to as XA) comprising vinylsilane and hydrosilane and 0.08 g (20% by mass) of a resin (KR242A made by Shin-Etsu Chemical Co., Ltd.: hereinafter referred to as KR) chiefly comprising a methyl-based straight silicone resin (silicon oxide precursor) were dissolved in 50 ml of isopropyl alcohol to make the solution for use in the silicone resin insulating coating layer. Drying was performed in the same way as for Example 1. Further, using a solution dissolving 0.24 g (60% by mass) of XA and 0.16 g (40% by mass) of KR, a solution dissolving 0.16 g (40% by mass) of XA and 0.24 g (60% by mass) of KR, and a solution dissolving 0.08 g (20% by mass) of XA and 0.32 g (80% by mass) of KR, silicon resin coating layers were made by the same method described above. Using the produced powders for powder magnetic cores, the respective powder magnetic cores were produced for every annealing temperature shown in FIG. 8 under the same conditions as for Example 1. The silicon resin coating layer was made by adding 0.4% by mass of the total silicone resin to the powder for a powder magnetic core.

Example 3

In the same way as for Example 2, a powder for a powder magnetic core was produced under the condition shown in FIG. 8. A powder magnetic core was produced from the powder for a powder magnetic core. The difference from Example 2 was that the powder for a powder magnetic core was produced by further coating the phosphate insulating layer with a Si—Al-based insulating layer and further coating the layer with a silicone resin insulating layer under the condition described below.

Specifically, 100 g of powder having a phosphate insulating layer formed, 100 ml of dehydrated tetrahydrofuran (THF), 0.04 g of Si-alkoxide, and 0.16 g of Al-alkoxide were put in a 500 ml flask in a globe box under a dehydrated nitrogen atmosphere. The flask was attached to a rotary evaporator to perform refluxing for 15 min. Subsequently, THF was removed by reduced-pressure distillation with final buffering under 100 Torr at 80° C. Subsequently, the powder was picked up and dried in a nitrogen atmosphere at 160° C. for 30 min to produce the Si—Al-based insulating coating layer.

Further, using a ratio of 60% by mass of XA and a ratio of 40% by mass of KR as a silicone resin and 50 ml of isopropyl alcohol as a solvent, the silicone resin insulating coating layer was made by adding 0.2% by mass of the silicone resin to the powder for a powder magnetic core. Subsequently, the powder for a powder magnetic core was heat-treated at 130° C. for 20 min.

Comparative Example 2

In the same way as for Examples 2 and 3, powder for a powder magnetic core was produced under the condition shown in FIG. 8. A powder magnetic core was produced from the powder for a powder magnetic core. The difference from Example 3 was that the powder for a powder magnetic resin was produced using a ratio of 100% by mass of XR.

[Evaluation 2]

In the same way as for Example 1, ring compression strength, magnetic flux density by an alternate current BH analyzer, and eddy losses were evaluated. The results are shown in FIGS. 9 to 14. The results in Example 1 and Comparative Example 1 are also incorporated in FIGS. 9 to 14.

Figure 9:
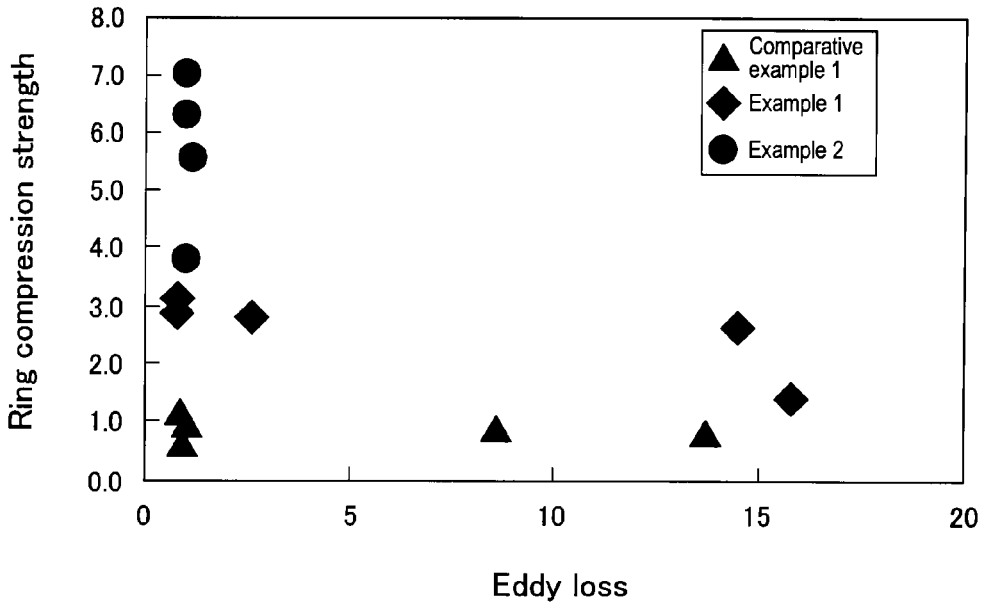
FIG. 9 shows relations between ring compression strength and eddy loss at an annealing temperature of 600° C. in Examples 1 and 2 and Comparative Example 1.
Figure 10:
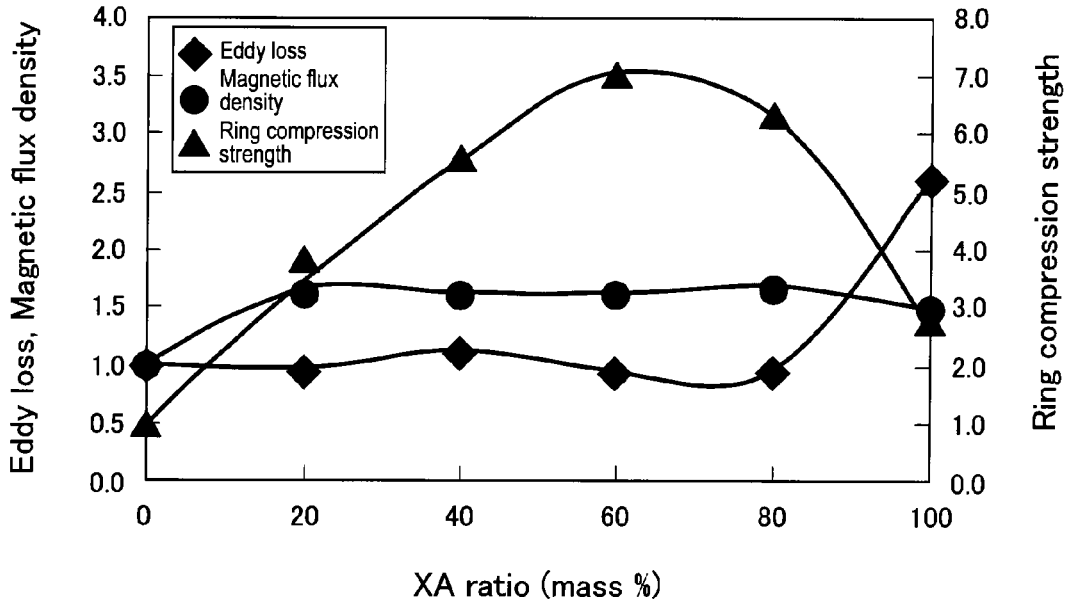
FIG. 10 shows relations between ring compression strength, eddy current loss (eddy loss), or magnetic flux density versus ratio of XA [% by mass] at an annealing temperature of 600° C.
Figure 11:
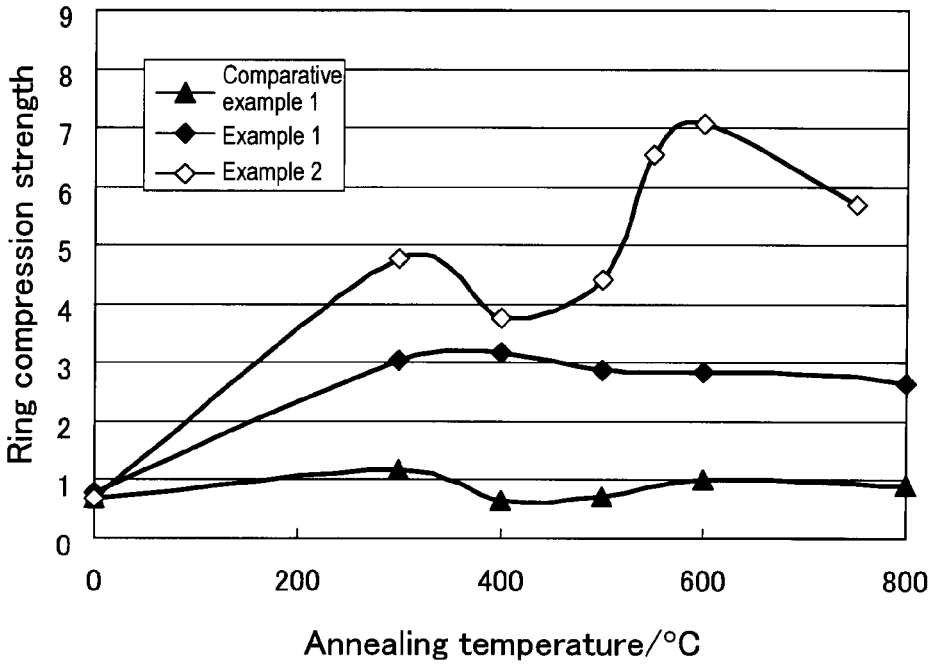
FIG. 11 shows relations between ring compression strength versus annealing temperature in Examples 1 and 2 and Comparative Example 1.
Figure 12:
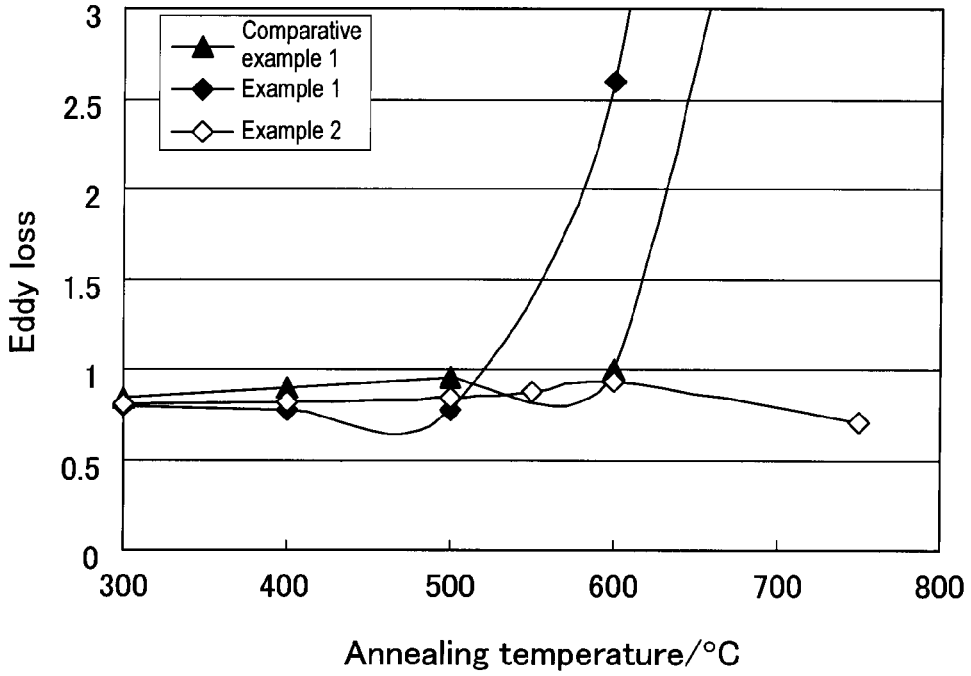
FIG. 12 shows relations between eddy loss versus annealing temperature in Examples 1 and 2 and Comparative Example 1.

FIG. 9 shows relations between ring compression strength and eddy loss at an annealing temperature of 600° C. in Examples 1 and 2 and Comparative Example 1. FIG. 10 shows relations between ring compression strength, eddy current loss (eddy loss), or magnetic flux density versus ratio of XA [% by mass] at an annealing temperature of 600° C. FIG. 11 shows relations between ring compression strength versus annealing temperature in Examples 1 and 2 and Comparative Example 1. FIG. 12 shows relations between eddy loss versus annealing temperature in Examples 1 and 2 and Comparative Example 1.

Figure 13:
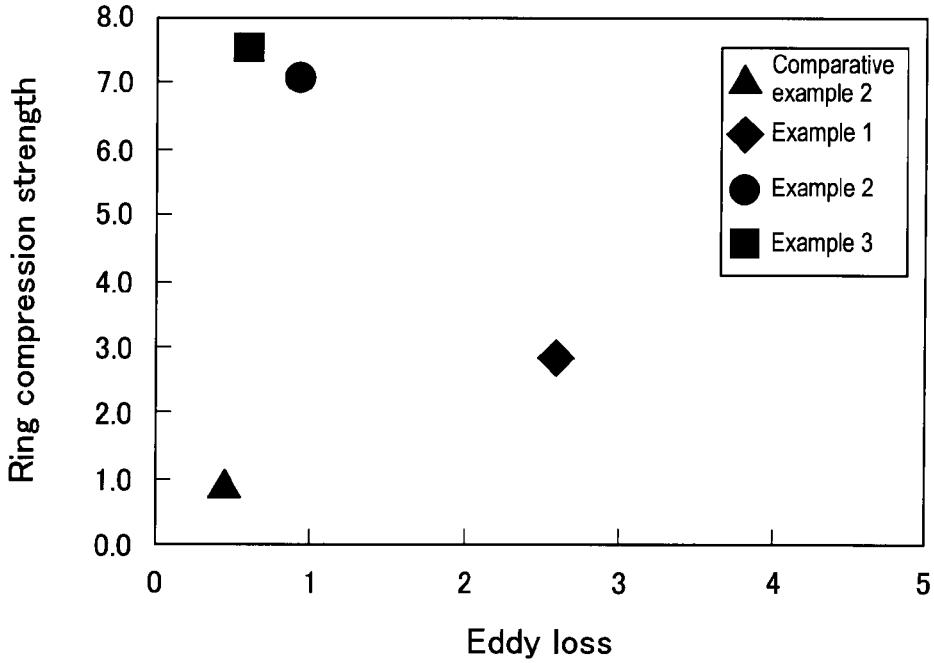
FIG. 13 shows relations between ring compression strength versus eddy loss in Examples 1 to 3 (at an annealing temperature of 600° C.) and Comparative Example 2.
Figure 14:
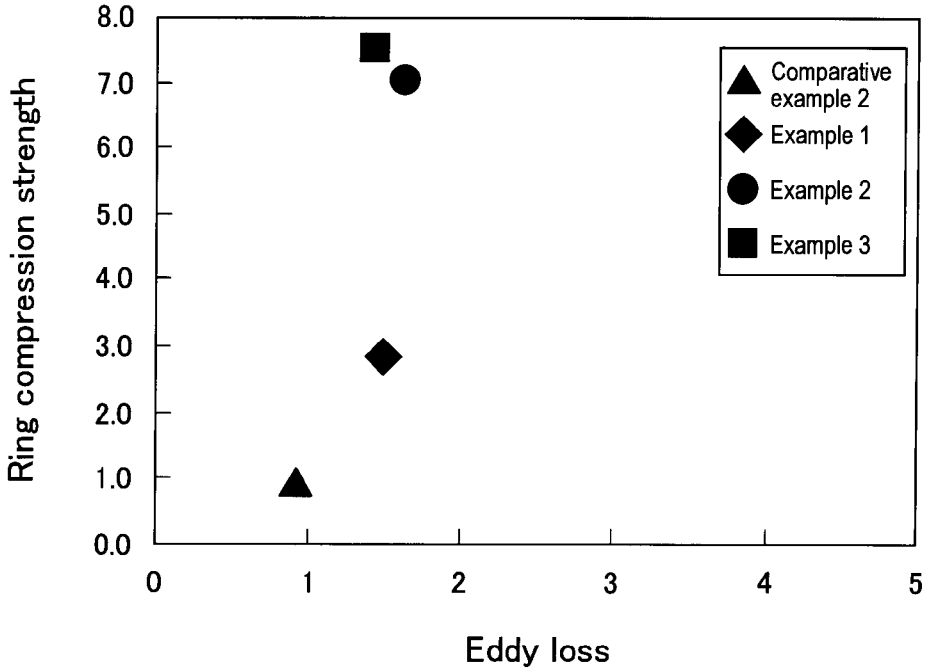
FIG. 14 shows relations between ring compression strength versus magnetic flux density in Examples 1 to 3 (at an annealing temperature of 600° C.) and Comparative Example 2.

FIG. 13 shows relations between ring compression strength versus eddy loss in Examples 1 to 3 (at an annealing temperature of 600° C.) and Comparative Example 2. FIG. 14 shows relations between ring compression strength versus magnetic flux density in Examples 1 to 3 (at an annealing temperature of 600° C.) and Comparative Example 2.

Content rates of Si—C═C or a vinyl group and Si—$CH_3$ or methyl group of the silicone resin made by blending these two kinds of silicone resins were measured with NMR and IR. The content rates mean the rates of numbers of vinyl groups and methyl groups in all the side chains of the blended silicone resin. It was also confirmed that the silicone resin comprised Si—H at a rate equal to or not lower than the rate of vinyl groups. The results are also shown in Table 1 below.

TABLE 1

| Content of XA (blending quantity of XA) [% by mass] | Content rate of vinyl group [%] | Content rate of methyl group [%] |
|---|---|---|
| 0 | 0 | 90 |
| 20 | 2 | 77 |
| 40 | 5 | 64 |
| 60 | 7 | 51 |
| 80 | 10 | 38 |
| 100 | 12 | 25 |

(Result 2 and Discussion 2)

As shown in FIG. 9, the ring compression strengths in Example 2 were higher than those in Example 1 and Comparative Example 1, and the eddy losses in Example 2 were lower than those of others. From these results, it is contemplated that the powder magnetic core in Example 2 preserved enhanced strength by hydrosilylation reaction during annealing and had lower eddy current losses (iron losses) than those in Example 1 by adding KR, which formed silicon oxide phases inhibiting volume reduction in the silicone resin insulating layer (inhibiting degradation of insulation).

As shown in FIG. 10, when a powder magnetic core was produced with a ratio of XA in the range from 20% by mass to 80% by mass, higher ring compression strength, no reduction in magnetic flux density, and inhibited increase in eddy losses were achieved compared to powder magnetic cores in Example 1 and Comparative Example 1. As shown in FIG. 10 and Table 1, preferably 2% to 10% of vinyl groups are comprised in all the side chains and 38% to 77% of methyl groups are comprised in all the side chains. It is contemplated that hydrosilylation reaction between these vinyl groups (vinylsilane) and hydrosilane contributes to the ring compression strength, and further the inclusion of —(Si—O)n- and $CH_3$ in the range shown in Table 1 inhibits volume reduction to contribute the reduction in eddy losses.

As shown in FIG. 11, the ring compression strengths in Example 2 were higher than those in Example 1 and Comparative Example 1 regardless of annealing temperature. It is deduced that the silicon oxide precursor KR comprised in the polymer resin insulating layer inhibited volume reduction in silicone resin insulating layer to produce a dense resin insulating layer, which enhanced the strength.

As shown in FIG. 12, when the annealing temperature was not lower than 600° C., the eddy losses in Example 1 and Comparative Example 1 increased, while the eddy losses in Example 2 did not increase and were lower than those in Comparative Examples 2 and 3. It is deduced that the eddy losses in Example 2 were inhibited compared to Comparative Example 1 due to formation of Si—C—C—Si bonds between the particles (between silicone resin insulating layers). In other words, it is contemplated that the formation of the Si—C—C—Si bonds inhibited condensation or displacement in the polymer resin layer, resulting in the reduction in eddy losses.

In addition, as shown in FIGS. 13 and 14, it is contemplated that since the further formed Si—Al-based insulating layer in Example 3 enhanced wettability and affinity of the silicone resin insulating layer, insulation was secured with a smaller amount of addition of the resin than the amounts in Examples 1 and 2. It is also contemplated that the high ring compression strength in Example 3 was achieved for the same reason as in Example 2 described above.

Example 4

Figure 15:
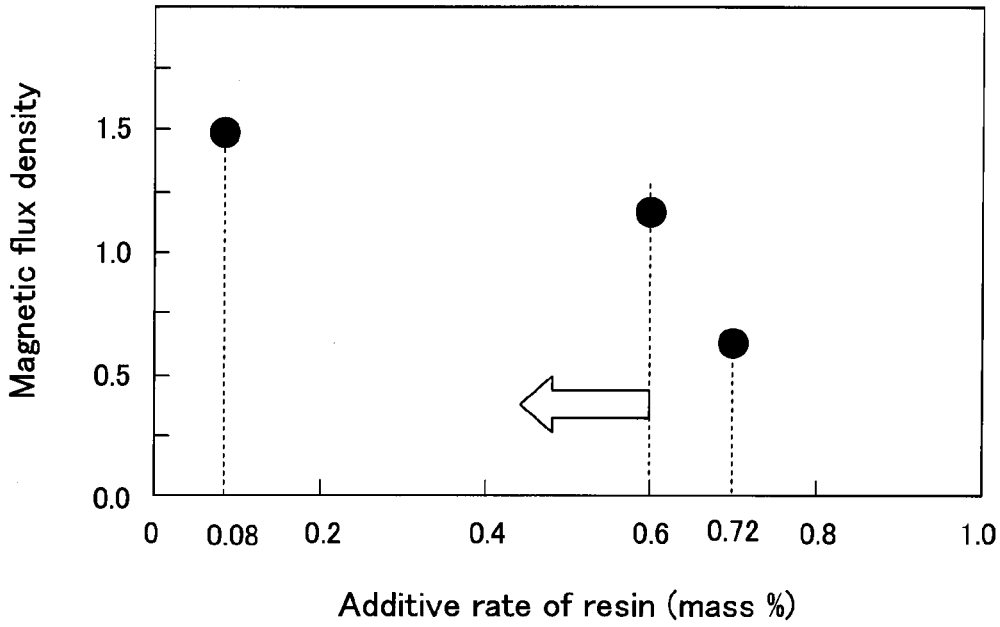
FIG. 15 shows relations between magnetic flux density versus additive rate of resin in powder magnetic cores in Example 4.

Powder magnetic cores were produced in the same way as for Example 3. The difference from Example 3 was that the silicone resin was added to the entire powder with rates shown in FIG. 15 (various additive rates of the resin) and the rate of XA to the entire silicone resin was 40% by mass. Further difference was that the powder for powder magnetic cores coated with the silicone resin insulating layer was heat-treated at 160° C. for 45 min. The magnetic flux density of the resulting powder magnetic core was measured in the same way as for Example 1. The results are shown in FIG. 15.

Example 5

Figure 16:
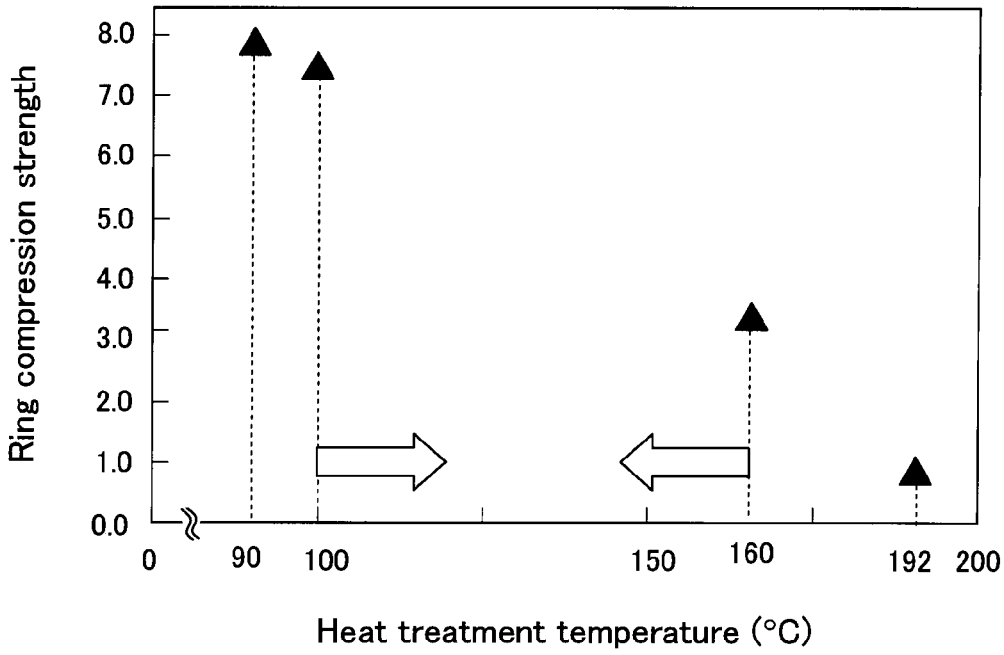
FIG. 16 shows relations between ring compression strength versus annealing temperature of the particle for powder magnetic cores in Example 5.

Powder magnetic cores were produced in the same way as for Example 4. The difference from Example 4 was that the silicone resin was added to the entire powder with a rate of 0.4% by mass and the powder for powder magnetic cores coated with the silicone resin insulating layer was heat-treated at various temperatures. The magnetic flux density and the eddy losses of the produced powder magnetic cores were measured in the same way as for Example 1. The results are shown in FIG. 16.

Example 6

Powder magnetic cores were produced in the same way as for Example 4. The difference from Example 4 was that the silicone resin was added to the entire powder with a rate of 0.4% by mass and the powder for powder magnetic cores coated with the silicone resin insulating layer was heat-treated during various time periods. The magnetic flux density and the eddy losses of the produced powder magnetic cores were measured in the same way as for Example 1. The results are shown in FIG. 17.

(Result 3 and Discussion 3)

As shown in FIG. 15, it is preferable that a rate of silicone resin insulating layer in a particle of powder for a powder magnetic core (rate of silicone resin), or an additive rate of silicone resin to the magnetic powder, is not higher than 0.6% by mass. It is contemplated that the magnetic flux density of a powder magnetic core and ring compression strength can be enhanced by formation of a silicone resin insulating layer with this rate.

Figure 17:
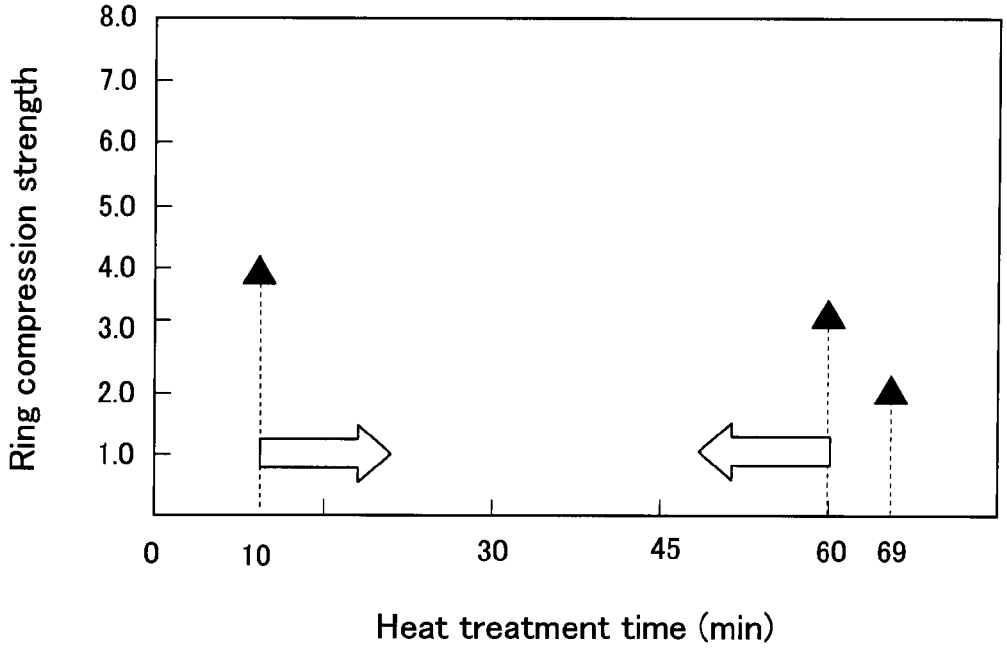
FIG. 17 shows relations between ring compression strength versus annealing time of the particle for powder magnetic cores in Example 6.
Figure 18:
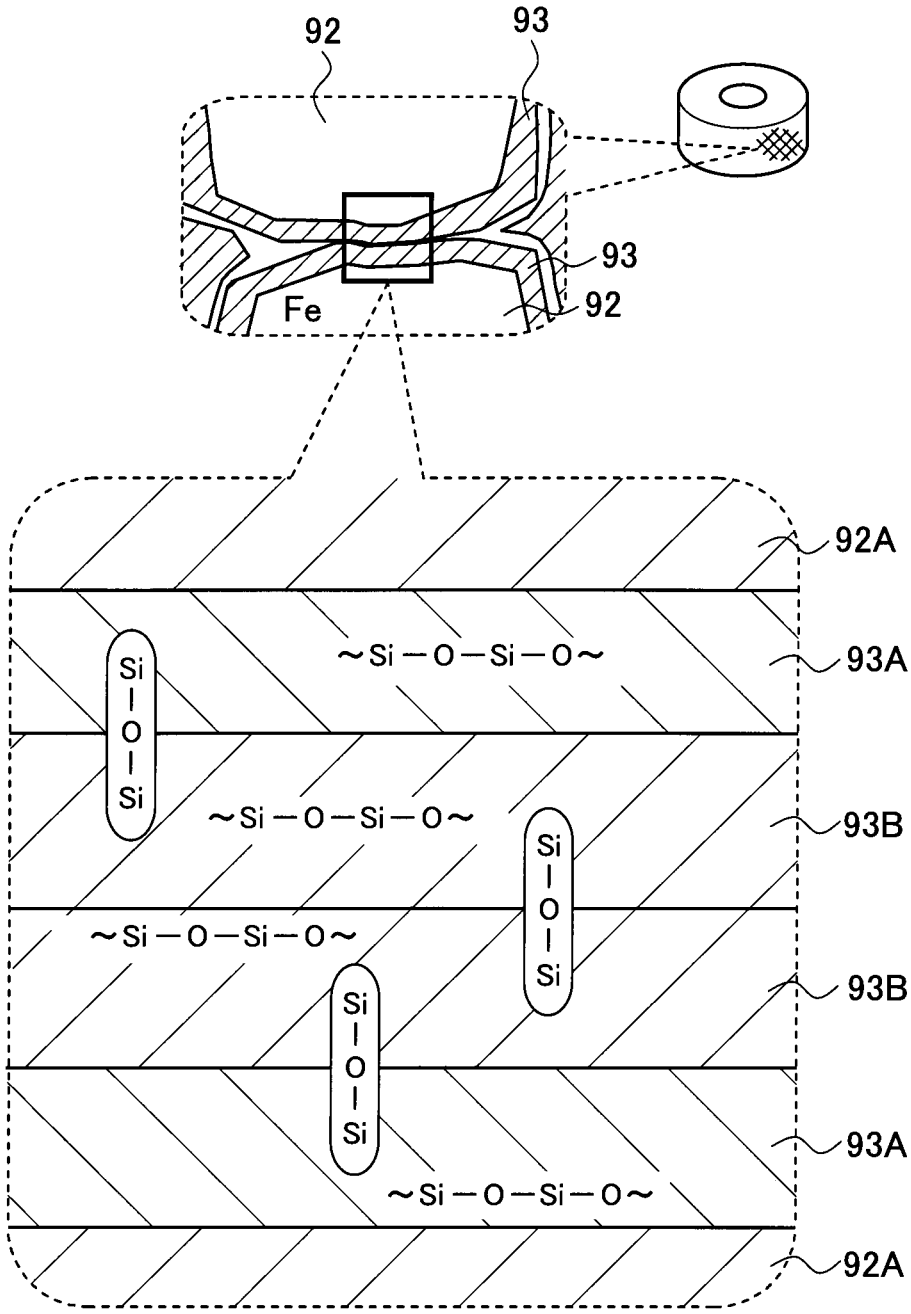
FIG. 18 illustrates a conventional powder magnetic core.

As shown in FIGS. 16 and 17, it is preferable that coated insulating polymer resin layers are heat-treated in a heating temperature region of 100° C. to 160° C. during a heating period of 10 min to 45 min. When the heating temperature was lower than 100° C., or when the heating period was less than 10 min, powder flowability was impaired supposedly due to unreacted functional groups. Specifically, when metal powder flowability is measured with a specified funnel in JIS2502-2000, the powder does not flow from the funnel due to the impaired flowability. The impaired flowability causes serious problems in mass production of a powder magnetic core. When the heating temperature is higher than 160° C., or when the heating period is more than 45 min, silicon oxide is substantially produced before forming the compacted powder magnetic core. Accordingly, silicon oxide is barely produced between particles during annealing of the powder magnetic core. It is deduced that sufficient effect of enhancing strength of the powder magnetic core is thus not produced.

Although embodiments of the present invention have been described with reference to the attached drawings, specific embodiments are not limited to the present embodiments and design changes may be made in the invention without departing from the scope of the invention.

For example, although the oxide insulating layer has two-layer structure in the present embodiments, the layer may be a single insulating layer comprising a phosphate salt or may have a multi-layer structure composed of not less than two layers, all of which may contain vinylsilane and hydrosilane.

The invention claimed is:

1. A powder for a powder magnetic core comprising magnetic particles wherein a surface of each of the magnetic particles is coated with an insulating layer, wherein the insulating layer comprises, as a surface layer, a polymer resin insulating layer comprising a polymer including polymerized monomers of vinylsilane and hydrosilane, the polymer resin insulating layer is a silicone resin insulating layer, the silicone resin constituting the silicone resin insulating layer comprises, as side chains, a methyl group and a vinyl group for inducing hydrosilylation reaction with the hydrosilane at interfaces between the magnetic particles, and the silicone resin comprises the vinyl group at 2% to 10% in all the side chains and the methyl group at 38% to 77% in all the side chains.

2. The powder for a powder magnetic core according to claim 1, further comprising an oxide insulating layer as an insulating layer between each of the magnetic particles and the polymer resin insulating layer.

3. The powder for a powder magnetic core according to claim 2, wherein the oxide insulating layer comprises a phosphate salt or an Al—Si-based oxide.

4. The powder for a powder magnetic core according to claim 2, wherein the oxide insulating layer has two-layer structure comprising an insulating layer comprising a phosphate salt and an insulating layer comprising Al—Si-based oxide arranged in series from the magnetic particle surface toward the polymer resin insulating layer.

5. The powder for a powder magnetic core according to claim 2, wherein the oxide insulating layer comprises vinylsilane.

6. The powder for a powder magnetic core according to claim 1, wherein the polymer resin insulating layer further comprises a silicon oxide precursor that produces silicon oxide by heating.

7. The powder for a powder magnetic core according to claim 1, wherein a rate of the polymer resin of the powder for a powder magnetic core is not higher than 0.6% by mass.

8. A powder for a powder magnetic core comprising magnetic particles wherein a surface of each of the magnetic particles is coated with an insulating layer, wherein the insulating layer comprises, as a surface layer, a polymer resin insulating layer comprising a polymer including polymerized monomers of vinylsilane and hydrosilane, the polymer resin insulating layer is a silicone resin insulating layer, the silicone resin constituting the silicone resin insulating layer comprises, as side chains, a methyl group and a vinyl group for inducing hydrosilylation reaction with the hydrosilane, and the silicone resin comprises the vinyl group at 2% to 10% in all the side chains and the methyl group at 38% to 77% in all the side chains, the powder further comprises an oxide insulating layer as an insulating layer between each of the magnetic particles and the polymer resin insulating layer, and the oxide insulating layer comprises vinylsilane so as to induce hydrosilylation reaction between the oxide insulating layer and the polymer resin insulating layer.

* * * * *